US008803086B2

(12) United States Patent
Shimomura

(10) Patent No.: US 8,803,086 B2
(45) Date of Patent: Aug. 12, 2014

(54) TRIPLE QUADRUPOLE MASS SPECTROMETER

(75) Inventor: Manabu Shimomura, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 14/129,461

(22) PCT Filed: Jun. 28, 2011

(86) PCT No.: PCT/JP2011/064799
§ 371 (c)(1),
(2), (4) Date: Dec. 26, 2013

(87) PCT Pub. No.: WO2013/001604
PCT Pub. Date: Jan. 3, 2013

(65) Prior Publication Data
US 2014/0131571 A1 May 15, 2014

(51) Int. Cl.
*H01J 49/00* (2006.01)

(52) U.S. Cl.
CPC ..... *H01J 49/0045* (2013.01)
USPC ..... 250/292; 250/396 R; 250/281

(58) Field of Classification Search
USPC ..... 250/292, 290, 396 R, 281, 282
See application file for complete search history.

(56) References Cited

U.S. PATENT DOCUMENTS

| | | | | |
|---|---|---|---|---|
| 3,410,997 | A | 11/1968 | Brubaker | |
| 6,987,261 | B2 * | 1/2006 | Horning et al. | 250/282 |
| 8,242,437 | B2 * | 8/2012 | Itoi et al. | 250/281 |

FOREIGN PATENT DOCUMENTS

| | | | |
|---|---|---|---|
| CA | 1 249 381 | A | 1/1989 |
| EP | 0 237 259 | A2 | 9/1987 |
| JP | 62-264546 | A | 11/1987 |
| JP | 2000-243347 | A | 9/2000 |
| JP | 2006-189298 | A | 7/2006 |
| JP | 2009-180731 | A | 8/2009 |

* cited by examiner

*Primary Examiner* — Kiet T Nguyen
(74) *Attorney, Agent, or Firm* — Sughrue Mion, PLLC

(57) ABSTRACT

Elements are arranged so that a straight ion-beam axis extending from an ion source through a first ion lens and a front-stage quadrupole mass filter and a straight ion-beam axis extending through the ion guide in a collision cell and a rear-stage quadrupole mass filter obliquely intersect with each other at a predetermined angle in a space between the front-stage quadrupole mass filter and the collision cell. Metastable helium molecules generated in the ion source may pass through the front-stage quadrupole mass filter but will be removed before reaching the exit of the collision cell. On the other hand, precursor ions which have passed through the front-stage quadrupole mass filter are made to bend along an inflected ion-beam axis under the influence of a direct-current electric field created by an entrance ion lens, to be efficiently introduced into the collision cell.

3 Claims, 2 Drawing Sheets

TRIPLE QUADRUPOLE MASS SPECTROMETER

CROSS REFERENCE TO RELATED APPLICATIONS

This is a National Stage of International Application No. PCT/JP2011/064799 filed Jun. 28, 2011, the contents of which are incorporated herein by reference in their entirety.

TECHNICAL FIELD

The present invention relates to a triple quadrupole mass spectrometer in which an ion having a specific mass-to-charge ratio m/z is dissociated by collision-induced dissociation and the thereby produced product ions (fragment ions) are subjected to a mass spectrometry. In particular, it relates to a triple quadrupole mass spectrometer suitable as a detector for a gas chromatograph.

BACKGROUND ART

A method called an MS/MS analysis (or tandem analysis) is known as one of the mass spectrometric techniques for identification, structural analyses or quantitative determination of a substance having a large molecular weight. A triple quadrupole mass spectrometer is a typical example of MS/MS mass spectrometers.

FIG. 3 is a schematic configuration diagram of a commonly used triple quadrupole mass spectrometer. This triple quadrupole mass spectrometer is provided with a collision cell 14 including an ion guide 15 having four or more poles, with two quadrupole mass filters 13 and 18 for separating ions according to their mass-to-charge ratios m/z respectively provided on the front and rear sides of the collision cell 14. Among a variety of ions produced in an ion source 11, only a target ion having a specific mass-to-charge ratio is selected by the front-stage quadrupole mass filter 13 and introduced into the collision cell 14. The introduced ion collides with CID gas within the collision cell 14, to be dissociated into various kinds of product ions. Since this dissociation occurs in various forms, a plurality of kinds of product ions with different mass-to-charge ratios are normally produced from one kind of precursor ion. Those kinds of product ions are introduced into the rear-stage quadrupole mass filter 18, by which only an ion having a specific mass-to-charge ratio is selectively allowed to reach the detector 19.

The mass-to-charge ratio of an ion that can pass through the quadrupole mass filters 13 and 18 depends on the values of the radio-frequency voltage and the direct-current voltage applied to the rod electrodes constituting those mass filters 13 and 18. Accordingly, by continuously varying the mass-to-charge ratio of an ion that can pass through one of the front-stage and rear-stage quadrupole mass filters 13 and 18 while maintaining the mass-to-charge ratio of an ion that can pass through the other one of the quadrupole mass filters 13 and 18, it is possible to perform a precursor-ion scan for searching for every precursor ion from which a specific kind of product ion is produced, or conversely, a product-ion scan for searching for every product ion which is produced from a specific kind of precursor ion. A neutral-loss scan for searching for every precursor ion from which a specific kind of structural part is desorbed can also be performed, in which case the mass-to-charge ratios at which ions are allowed to pass through the two quadrupole mass filters 13 and 18 are continuously varied so that the two selected ions constantly maintain a specific difference in mass-to-charge ratio.

Mass spectrometers, including the triple quadrupole mass spectrometers, are often used as a detector for a gas chromatograph (GC) or liquid chromatograph (LC) for temporally separating various kinds of components in a sample. In the case of a GC/MS having a gas chromatograph (GC) combined with a mass spectrometer, the largest portion of the sample gas introduced into the ion source 11 of the mass spectrometer is the carrier gas used in the GC. As the carrier gas, a noble gas, such as helium (He), is generally used. In particular, when an electron ionization method is used, helium easily receives an amount of energy in the ion source and turns into a metastable atom (molecule). Metastable helium is hereinafter expressed as He*.

A He* molecule is electrically neutral but has a higher level of excitation energy than stable helium, He. Therefore, if a He* molecule is ejected from the ion source 11 and travels like an ion, the He* molecule interacts with various kinds of surrounding atoms or molecules, causing a self-ionization of He*, or conversely, a secondary ionization of the surrounding atoms or molecules. Ions produced by such processes constitute a major cause of the background noise and lower the signal-to-noise ratio. To reduce such a noise due to the He* molecules (or the atoms or molecules of other kinds of metastable noble gas), various configurations for the mass spectrometer have been conventionally proposed.

For example, in a mass spectrometer disclosed in Patent Document 1, a curved ion guide is used, in which target ions are made to travel along a curved ion-beam axis, while the electrically neutral He* molecules are made to travel straight and deviate from the ion-beam axis. Thus, He* molecules are prevented from entering the mass analyzer and the detector which are located on the rear side of the ion guide.

In the mass spectrometers disclosed in Patent Documents 2 and 3, a collision chamber into which $N_2$ or similar inert gas is introduced is provided on the front side of the mass analyzer, and He* is passed through this chamber so as to make He* and $N_2$ come in contact with each other and thereby ionize N while turning He* into stable helium, He. Thus, the metastable helium (He*) is prevented from entering the mass analyzer.

However, any of the previously described conventional techniques has a problem. That is to say, the ion guide for transporting ions normally consists of a plurality of multi-pole rods with four or more poles, and assembling curved multi-pole rods with high dimensional accuracy is considerably expensive. Furthermore, if its mechanical accuracy is inadequate, the passing efficiency of the target ion will be low, which leads to a decrease in the sensitivity.

In the case of removing He* by making it come in contact with $N_2$ or similar gas, the target ion is also made to pass through the same gas area, so that the passing efficiency of the ions deteriorates and the signal level in the detector decreases. Therefore, the S/N ratio does not always improve even if the noise is reduced. Another problem is that converting He* into He requires creating an area with a considerably high density of $N_2$ gas, which means that a high evacuation power is needed to maintain the neighboring vacuum chamber in a high-vacuum state.

BACKGROUND ART DOCUMENT

Patent Document

Patent Document 1: U.S. Pat. No. B2 3,410,997
Patent Document 2: JP-A 2006-189298
Patent Document 3: JP-A 2009-180731

SUMMARY OF THE INVENTION

Problem to be Solved by the Invention

The present invention has been developed to solve the previously described problems, and its primary objective is to provide a triple quadrupole mass spectrometer in which a noise due to a metastable atom (or molecule) produced from the atom (or molecule) of a noble gas contained in a sample gas is satisfactorily suppressed without using an ion optical element or another member having a special shape or structure and without lowering the degree of vacuum within a vacuum chamber in which quadrupole mass filters or other components are provided.

Means for Solving the Problem

The present invention aimed at solving the previously described problems is a triple quadrupole mass spectrometer including: an ion source for ionizing sample components; a front-stage quadrupole mass filter for selecting, as a precursor ion, an ion having a specific mass-to-charge ratio from among various ions produced by the ion source; a collision cell for dissociating the precursor ion by making the precursor ion collide with a predetermined gas, the collision cell containing an ion guide for transporting ions while focusing the ions by a radio-frequency electric field; a rear-stage quadrupole mass filter for selecting an ion having a specific mass-to-charge ratio from among various product ions produced by dissociation of the precursor ion; and a detector for detecting the product ion selected by the rear-stage quadrupole mass filter, wherein:

the front-stage quadrupole mass filter and the ion guide are arranged so that a straight ion-beam axis in the front-stage quadrupole mass filter and a straight ion-beam axis in the ion guide obliquely intersect with each other, forming an inflected line in a space between the front-stage quadrupole mass filter and the collision cell; and a voltage supplier for applying a direct-current voltage to an ion lens provided at an entrance of the collision cell, so as to form a direct-current electric field by which an ion which has passed through the front-stage quadrupole mass filter is made to bend along the inflected ion-beam axis.

In a preferable mode of the triple quadrupole mass spectrometer according to the present invention, the intersection angle of the straight ion-beam axis in the first quadrupole mass filter and the straight ion-beam axis in the ion guide is set so that an ion-exit aperture of the collision cell is out of sight through the inner space of the front-stage quadrupole mass filter as viewed through an aperture of an ion lens provided at an entrance of the front-stage quadrupole mass spectrometer.

In the triple quadrupole mass spectrometer according to the present invention, when atoms (or molecules) of a noble gas (e.g. helium) introduced into the ion source along with sample components are turned into metastable atoms and introduced into the first mass filter, most of the metastable atoms pass through the front-stage quadrupole mass filter without being influenced by the electric field created by the front-stage quadrupole mass filter. On the other hand, when various ions produced in the ion source (including the ions originating from the noble-gas atoms or molecules) are introduced into the front-stage quadrupole mass filter, the ions are made to oscillate due to the effect of the radio-frequency electric field and the direct-current electric field created by the quadrupole mass filter, and only the ions having a specific mass-to-charge ratio pass through the front-stage quadrupole mass filter. The ions that have passed through the front-stage quadrupole mass filter are made to bend along a path which on the whole extends along the inflected ion-beam axis, due to the effect of the direct-current electric field created by the direct-current voltage applied to the ion lens provided at the entrance of the collision cell. This direct-current electric field also has the effect of imparting kinetic energy to the ions, and the ions are dissociated within the collision cell due to the collision energy which depends on that kinetic energy. To this aim, the direct-current electric field created by the ion lens provided at the entrance of the collision cell is made strong enough to impart an appropriate amount of kinetic energy to the ions. The ions exiting from the front-stage quadrupole mass filter are converged into the vicinity of the ion-beam axis since their oscillations is suppressed due to the effect of the electric field created inside the mass filter. Accordingly, the ions form an ion flux with a comparatively high degree of parallelism (i.e. approximately parallel to the ion-beam axis) when they arrive in the direct-current electric field created by the ion lens. Therefore, it is possible to make the ions appropriately bend along the inflected ion-bean axis even if an ion lens having a simple structure is used.

By contrast, the metastable ions which have passed through the front-stage quadrupole mass filter are insusceptible to the influence of the aforementioned direct-current electric field and maintain the same traveling path even after they enter the direct-current electric field. As a result, the metastable ions do not follow the inflected ion-beam axis but travel in a direction at a considerable angle to the straight ion-beam axis in the ion guide. Therefore, any metastable atoms which have entered the collision cell will come in contact with the ion guide or the inner wall of the collision cell, to be eventually annihilated halfway. In particular, in the case of the previously described preferable mode of the present invention, most of the metastable atoms entering straight from the ion source into the inner space of the front-stage quadrupole mass filter will be annihilated before reaching the ion-exit aperture of the collision cell. Thus, the metastable atoms are assuredly prevented from entering the rear-stage quadrupole mass filter. Even a mere entry of metastable atoms into the rear-stage quadrupole mass filter can constitute a major cause of the generation of noise, since those atoms can cause unwanted generation of secondary ions even if they do not completely pass through the rear-stage quadrupole mass filter. Preventing the metastable ions from entering the rear-stage quadrupole mass filter significantly suppresses the noise due to the metastable atoms.

One might think that the section in which the two ion-beam axes are made to intersect with each other in order to remove the metastable atoms could be located between the collision cell and the rear-stage quadrupole mass filter rather than between the front-stage quadrupole mass filter and the collision cell. However, this design may possibly allow the metastable atoms to enter the rear-stage quadrupole mass filter and generate secondary ions inside that filter. Those ions generated inside the rear-stage quadrupole mass filter may not be adequately removed, and some of them may reach the detector. Accordingly, in order to assuredly reduce the noise due to the metastable atoms, the intersecting section of the ion-beam axes should preferably be located on the front side of the collision cell (i.e. on the side closer to the ion source).

One might also think that the section in which the two ion-beam axes are made to intersect with each other in order to remove the metastable atoms could be located between the ion source and the front-stage quadrupole mass filter rather than between the front-stage quadrupole mass filter and the collision cell. However, in that case, it is impossible to make a variety of ions bend along the inflected ion-beam axis. The reason is as follows: In general, ions released from the ion source significantly vary in their traveling direction. Therefore, the ion flux introduced into the ion lens located before the front-stage quadrupole mass filter has a low degree of parallelism. Although the ion lens has the function of focusing a somewhat non-parallel stream of incident ions on an entrance end plane of the front-stage quadrupole mass filter (i.e. an entrance plane on which ions can be received), it barely has the capability to converge ions and improve the degree of parallelism of the ion flux. Therefore, it is difficult to bend the trajectory of the ions coming at various incidence angles and send them into the quadrupole mass filter with low loss. Thus, the attempt to provide the ion-curving section in the space between the ion source and the front-stage quadrupole mass filter only results in a decrease in the efficiency of introducing the ions into the front-stage quadrupole mass filter and a consequent decrease in the accuracy and sensitivity of the analysis.

Accordingly, it can be said that, for the purpose of efficiently transporting target ions and suppressing a decrease in the accuracy and sensitivity of the analysis while assuredly preventing noise, the space between the front-stage quadrupole mass filter and the collision cell is the optimal choice of location for the section in which the two ion-beam axes are made to intersect with each other in order to remove the metastable atoms.

The triple quadrupole mass spectrometer according to the present invention is particularly useful in the case where metastable atoms are easily produced. Therefore, the present invention works effectively when applied in a system in which, as described earlier, the sample gas contains helium as its primary component, or more specifically, in which a triple quadrupole mass spectrometer is used as a detector for detecting components in a sample gas exiting from a column of a gas chromatograph.

Effect of the Invention

In the triple quadrupole mass spectrometer according to the present invention, entry of metastable atoms into the rear-stage quadrupole mass filter can be prevented without using an ion optical element having a special shape or structure, such as a curved ion guide; what is required from structural points of view is to skillfully design the arrangement of existing elements, such as the quadrupole mass filters, the collision cell and the ion guide. Therefore, it is possible to reduce the noise due to the metastable atoms and improve the S/N ratio without significantly increasing the cost. Furthermore, since there is no need to introduce a large amount of gas into the vacuum chamber for the purpose of removing the metastable atoms, it is unnecessary to increase the evacuation power.

MODE FOR CARRYING OUT THE INVENTION

One embodiment of the triple quadrupole mass spectrometer according to the present invention is hereinafter described with reference to the attached drawings.

Figure 1:
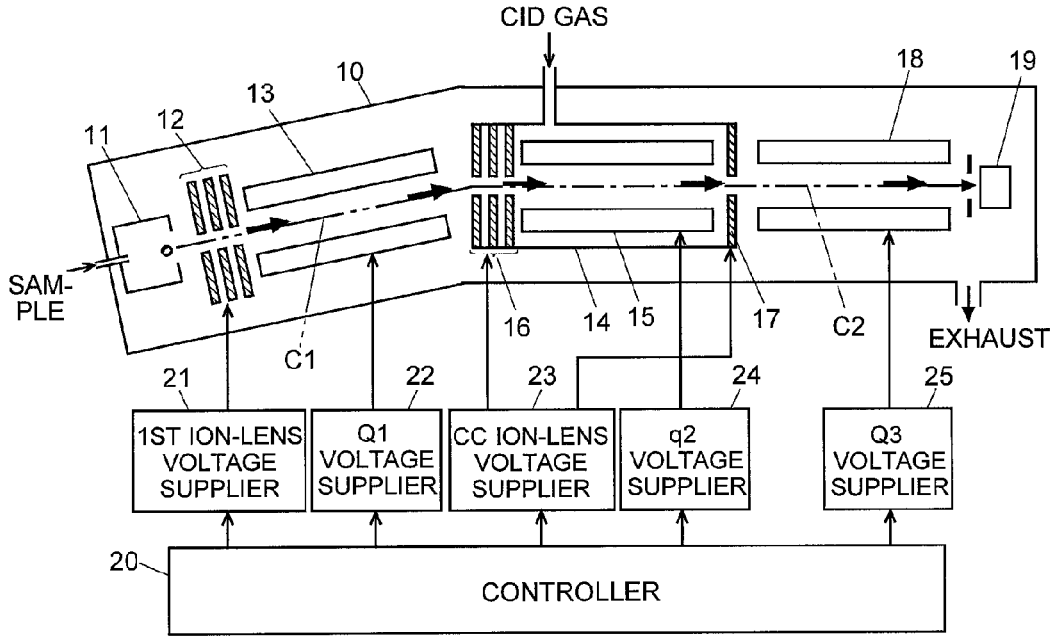
FIG. 1 is a schematic configuration diagram of a triple quadrupole mass spectrometer according to one embodiment of the present invention.
Figure 2:
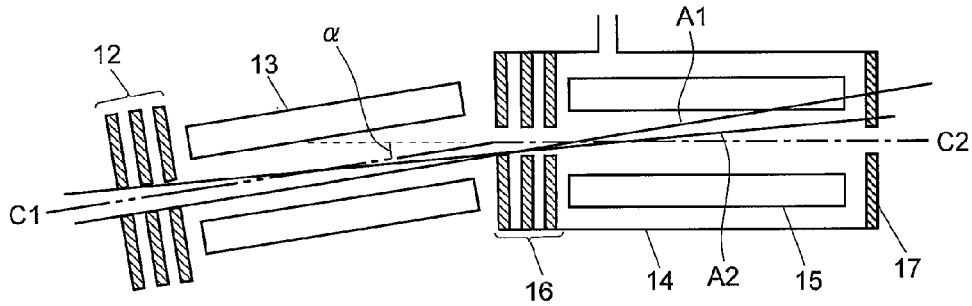
FIG. 2 is an enlarged view of an area including a section in which ion-beam axes obliquely intersect with each other in the triple quadrupole mass spectrometer of the present embodiment.
Figure 3:
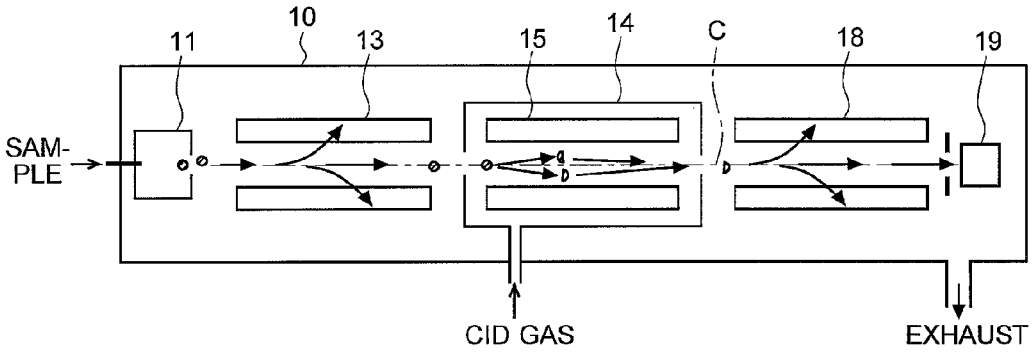
FIG. 3 is an overall configuration diagram of a commonly used triple quadrupole mass spectrometer.

FIG. 1 is a schematic configuration diagram of the triple quadrupole mass spectrometer of the present embodiment, and FIG. 2 is an enlarged view of an area including a section in which ion-beam axes obliquely intersect with each other in the triple quadrupole mass spectrometer of the present embodiment. It should be noted that the same components as used in the already described conventional system are denoted by the same numerals.

In the triple quadrupole mass spectrometer of the present embodiment, a first ion lens 12 is provided between the ion source 11 and the front-stage quadrupole mass filter (Q1) 13. A direct-current voltage is applied from a first ion-lens voltage supplier 21 to the first ion lens 12. By this direct-current voltage, a direct-current electric field for converging various ions released from the ion source 11 and introducing those ions into the front-stage quadrupole mass filter 13 is created in a space near the aperture of the first ion lens 12. A composite voltage consisting of a direct-current voltage and a radio-frequency voltage is applied from a Q1 voltage supplier 22 to each of the rod electrodes constituting the front-stage quadrupole mass filter 13. Ions having a mass-to-charge ratio corresponding to the composite voltage can pass through the front-stage quadrupole mass filter 13. The ion-beam axis C1 extending from the ion source 11 through the first ion lens 12 and the front-stage quadrupole mass filter 13 is in the form of a substantially straight line.

An entrance ion lens 16 and an exit ion lens 17 are respectively provided at the entrance and exit ends of the collision cell 14 in which a multi-pole ion guide 15 is installed. The aperture of the entrance ion lens 16 corresponds to the ion-entrance aperture to the collision cell 14, and the aperture of the exit ion lens 17 corresponds to the ion-exit aperture from the collision cell 14. A direct-current voltage is applied from a CC ion-lens voltage supplier 23 to each of the entrance and exit ion lenses 16 and 17. A radio-frequency voltage is applied from a q2 voltage supplier 24 to each of the rod electrodes constituting the ion guide 15. This voltage has the effect of transporting precursor ions or product ions while converging them. A composite voltage consisting of a direct-current voltage and a radio-frequency voltage is applied from a Q3 voltage supplier 25 to each of the rod electrodes constituting the rear-stage quadrupole mass filter 18. Ions having a mass-to-charge ratio corresponding to this composite voltage can pass through the rear-stage quadrupole mass filter 18.

The ion-beam axis C2 extending from the entrance ion lens 16 through the ion guide 15, the exit ion lens 17 and the rear-stage quadrupole mass filter 18 is in the form of a substantially straight line. The first and second ion-beam axes C1 and C2 obliquely intersect with each other at angle $\alpha$ within the space between the first quadrupole mass filter 13 and the collision cell 14, forming an inflected ion-beam axis on the whole. That is to say, the arrangement of the components inside the analyzing chamber 10, which is to be evacuated, are determined so that the first and second ion-beam axes C1 and C2 will be formed in the previously described way.

One of the effects of the direct-current electric field created by the direct-current voltage applied to the entrance ion lens 16 is to impart kinetic energy to ions so as to send them into the collision cell 14 and promote dissociation of the ions through collision with the CID gas. Another effect of the direct-current electric field is to bend the trajectory of the ions coming along the first ion-beam axis C1 so as to send them into the collision cell 14 along the second ion-beam axis C2.

As shown in FIG. 2, the intersection angle of the first and second ion-beam axes C1 and C2 is α. This angle α is determined so that the ion-exit aperture of the collision cell 14 (the aperture of the exit ion lens 17) is out of sight when the inside of the front-stage quadrupole mass filter 13 is viewed through the aperture of the first ion lens 12. Accordingly, the angle α depends on the aperture diameter of the first ion lens 12, the length of the front-stage quadrupole mass filter 13, the aperture diameter of the entrance ion lens 16, the aperture diameter of the exit ion lens 17, the length of the collision cell 14 or the ion guide 15, and other factors. Once the sizes and arrangement of those elements are fixed, the angle α can be uniquely determined. When such conditions are satisfied, the particles which enter the front-stage quadrupole mass filter 13 at various incidence angles through the aperture of the first ion lens 12 and travel straight cannot reach the exit aperture of the collision cell 14 even if they enter the collision cell 14, as indicated by A1 and A2 in FIG. 2.

An analyzing operation by the triple quadrupole mass spectrometer of the present embodiment is hereinafter described. A gas containing sample components is carried from the exit of a column of a gas chromatograph (not shown) into the ion source 11, which uses an electron ionization method. In this ion source 11, the sample components are ionized due to the action of thermions, and simultaneously, the helium used as the carrier gas is also ionized. Some of the helium atoms do not turn into ions but are merely energized and turn into metastable helium, He*. Since the amount of helium is overwhelmingly larger than that of sample components, the amount of helium ions and He* molecules thus produced is also very large. The ions created in the ion source 11 are drawn from the ion source 11 due to the effect of an electric field, to be converged by the first ion lens 12 and sent into the front-stage quadrupole mass filter 13. Under the control of the controller 20, a predetermined voltage is applied from the Q1 voltage supplier 22 to the front-stage quadrupole mass filter 13. Only the ions having a mass-to-charge ratio corresponding to that voltage pass through the front-stage quadrupole mass filter 13. Helium ions are normally removed at this stage.

On the other hand, He* molecules, which are electrically neutral, are insusceptible to the influence of the electric field in the front-stage quadrupole mass filter 13 and travel almost straight in the direction along which it has entered the front-stage quadrupole mass filter 13. Therefore, although a portion of the He* molecules come in contact with the front-stage quadrupole mass filter 13 and become annihilated, a considerable amount of those atoms pass through the front-stage quadrupole mass filter 13. Subsequently, the He* molecules travel almost straight, without being affected by the direct-current electric field created by the entrance ion lens 16. As indicated by A1 and A2 in FIG. 2, the He* molecules passing through the front-stage quadrupole mass filter 13 describe various trajectories; some of them collide with the entrance ion lens 16 and become annihilated, while a portion of those atoms pass through the aperture of the entrance ion lens 16 and enter the collision cell 14. However, as already explained, the straight-travelling He* molecules cannot reach the exit aperture of the collision cell 14; they collide with the ion guide 15 or the exit ion lens 17 and become annihilated.

The ions having a specific mass-to-charge ratio (precursor ions) which have passed through the front-stage quadrupole mass filter 13 travel along the ion-beam axis C1. Upon arriving in an area near the entrance ion lens 16, the ions begin to follow a bent path due to the effect of the direct-current electric field created by the ion lens 16. They also receive an amount of kinetic energy at this stage. Although the ions exiting from the front-stage quadrupole mass filter 13 are oscillating, this oscillation is adequately dampened while the ions are passing through the mass filter 13. Therefore, the ions are considerably collimated, so that their trajectories can be efficiently deflected, for example, even by a direct-current electric field created by an ion lens composed of ring-shaped electrodes. As a result, the precursor ions are efficiently introduced into the collision cell 14, in which the ions come in contact with the CID gas, to be dissociated into various product ions. Being bound by the radio-frequency electric field created by the ion guide 15, the product ions travel along the ion-beam axis C2, to be ejected from the collision cell 14 and introduced into the rear-stage quadrupole mass filter 18. Thus, the He* molecules are assuredly removed before reaching the rear-stage quadrupole mass filter 18, while the product ions are efficiently introduced into the rear-stage quadrupole mass filter 18 and subjected to a mass spectrometry.

When the He* molecules collide with the ion guide 15 or the exit ion lens 17, helium ions or other kinds of secondary ions may be produced within the collision cell 14. However, these ions are removed by the rear-stage quadrupole mass filter 18 and hence will not reach the detector 19.

Thus, in the triple quadrupole mass spectrometer of the present embodiment, although the individual ion optical elements (e.g. the ion lenses, the ion guide, and so on) have basically the same structures as the conventional counterparts, the measurement of product ions originating from a target precursor ion can be performed with higher sensitivity, while removing He* molecules which constitute a cause of noise, by skillfully designing the overall arrangement including the aforementioned elements and by appropriately regulating the direct-current voltage applied to the ion lens located at the entrance of the collision cell 14 as needed.

It should be noted that the previous embodiment is a mere example of the present invention, and any change, addition or modification appropriately made within the spirit of the present invention will evidently fall within the scope of claims of the present patent application.

EXPLANATION OF NUMERALS

10 . . . Analyzing Chamber
11 . . . Ion Source
12 . . . First Ion Lens
13 . . . Front-Stage Quadrupole Mass Filter
14 . . . Collision Cell
15 . . . Ion Guide
16 . . . Entrance Ion Lens
17 . . . Exit Ion Lens
18 . . . Rear-Stage Quadrupole Mass Filter
19 . . . Detector
20 . . . Controller
21 . . . First Ion-Lens Voltage Supplier
22 . . . Q1 Voltage Supplier
23 . . . CC Ion-Lens Voltage Supplier
24 . . . q2 Voltage Supplier
25 . . . Q3 Voltage Supplier
C1 . . . First Ion-Beam Axis
C2 . . . Second Ion-Beam Axis

The invention claimed is:

1. A triple quadrupole mass spectrometer including: an ion source for ionizing sample components; a front-stage quadrupole mass filter for selecting, as a precursor ion, an ion having a specific mass-to-charge ratio from among various ions produced by the ion source; a collision cell for dissociating the precursor ion by making the precursor ion collide with a predetermined gas, the collision cell containing an ion guide for transporting ions while focusing the ions by a radio-frequency electric field; a rear-stage quadrupole mass filter for selecting an ion having a specific mass-to-charge ratio from among various product ions produced by dissociation of the precursor ion; and a detector for detecting the product ion selected by the rear-stage quadrupole mass filter, wherein:

the front-stage quadrupole mass filter, the ion guide, and the rear-stage quadrupole mass filter are arranged so that a straight ion-beam axis in the front-stage quadrupole mass filter and a straight ion-beam axis in the ion guide obliquely intersect with each other, forming an inflected line in a space between the front-stage quadrupole mass filter and the collision cell, while the straight ion-beam axis in the ion guide and a straight ion-beam axis in the rear-stage quadrupole mass filter are in a form of a straight line; and a voltage supplier for applying a direct-current voltage to an ion lens provided at an entrance of the collision cell, so as to form a direct-current electric field by which an ion which has passed through the front-stage quadrupole mass filter is made to bend along the inflected ion-beam axis.

2. The triple quadrupole mass spectrometer according to claim 1, wherein:

an intersection angle of the straight ion-beam axis in the front-stage quadrupole mass filter and the straight ion-beam axis in the ion guide is set so that an ion-exit aperture of the collision cell is out of sight through an inner space of the front-stage quadrupole mass filter as viewed through an aperture of an ion lens provided at an entrance of the front-stage quadrupole mass spectrometer.

3. The triple quadrupole mass spectrometer according to claim 2, wherein:

the triple quadrupole mass spectrometer is used as a detector for detecting components in a sample gas exiting from a column of a gas chromatograph.

* * * * *